United States Patent [19]

Beck

[11] Patent Number: 4,927,065

[45] Date of Patent: May 22, 1990

[54] ADJUSTABLE METERING CLOSURE CAP

[75] Inventor: James M. Beck, Carol Stream, Ill.

[73] Assignee: Creative Packaging Corp., Wheeling, Ill.

[21] Appl. No.: 338,482

[22] Filed: Apr. 13, 1989

Related U.S. Application Data

[63] Continuation of Ser. No. 169,603, Mar. 17, 1988, abandoned.

[51] Int. Cl.[5] ..... B67D 5/06

[52] U.S. Cl. ..... 222/520; 222/521; 222/524; 222/525

[58] Field of Search ..... 222/519, 520, 521, 522, 222/524, 525, 564, 547, 549, 71, 212

[56] References Cited

U.S. PATENT DOCUMENTS

| | | | |
|---|---|---|---|
| 1,288,356 | 12/1918 | Woods . | |
| 2,582,026 | 1/1952 | Friedman | 222/520 |
| 2,762,536 | 9/1956 | Eriksen | 222/519 |
| 3,032,240 | 5/1962 | Dunklee | 222/525 |
| 3,059,821 | 10/1962 | Kubiliunas | 222/520 |
| 3,216,630 | 11/1965 | Stull | 222/521 X |
| 3,261,504 | 7/1966 | Sabaka | 222/83 |
| 3,407,967 | 10/1968 | Stull | 222/48 |
| 3,433,394 | 3/1969 | Stull | 222/519 |
| 3,809,299 | 5/1974 | Sand et al. | 222/521 |
| 4,157,768 | 6/1979 | Britt | 222/42 |
| 4,383,623 | 5/1983 | Page, III | 222/521 |
| 4,424,918 | 1/1984 | Stull | 222/153 |
| 4,438,870 | 3/1984 | Stull | 222/521 X |
| 4,461,454 | 7/1984 | Vadnais | 251/350 |
| 4,474,314 | 10/1984 | Roggenburg, Jr. | 222/521 X |
| 4,705,181 | 11/1987 | Burke et al. | 215/220 |
| 4,754,899 | 7/1988 | Stull | 222/549 X |
| 4,805,807 | 2/1989 | Perne et al. | 222/153 |

*Primary Examiner*—Joseph J. Rolla
*Assistant Examiner*—David H. Bollinger
*Attorney, Agent, or Firm*—Silverman, Cass & Singer, Ltd.

[57] ABSTRACT

An adjustable metering closure cap which has an outer cap body which is adjustable along the length of a central metering post to provide more than one dispensing position. The inner periphery of the cap body cooperates with the outer periphery of the post along a portion of the length thereof by a push-pull or a screw type action or both to provide the closed and dispensing positions. The outer periphery of the metering post is configured with slots, grooves, ramps, steps or combinations thereof to provide the various metered dispensing openings.

13 Claims, 3 Drawing Sheets

FIG. 1
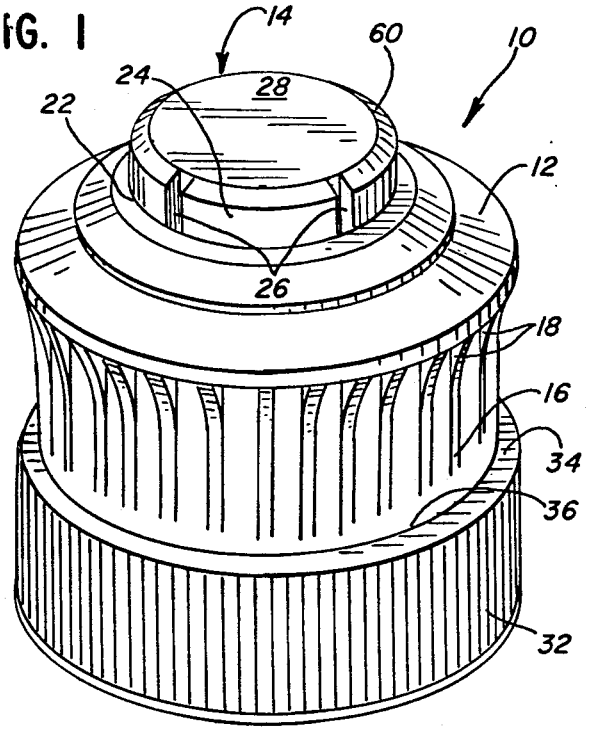
FIG. 2
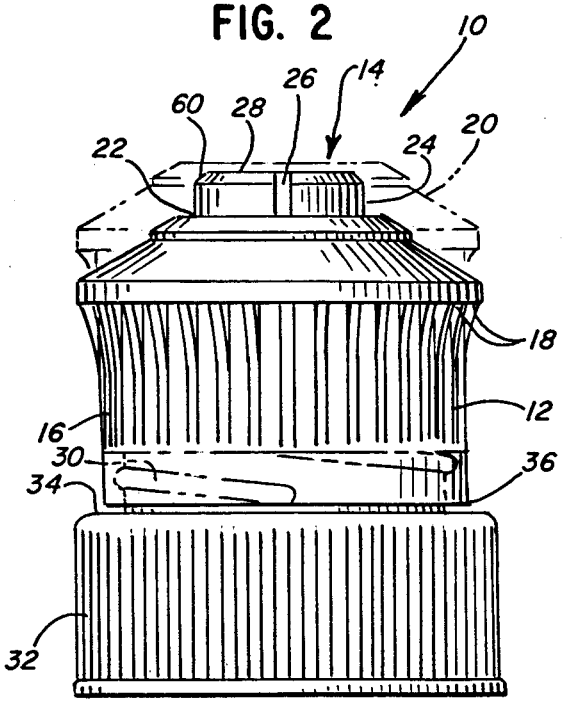
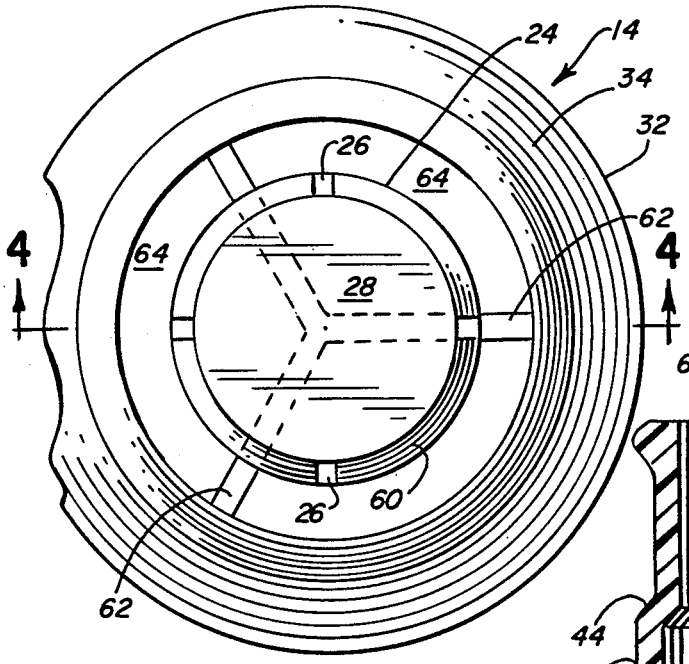
FIG. 3
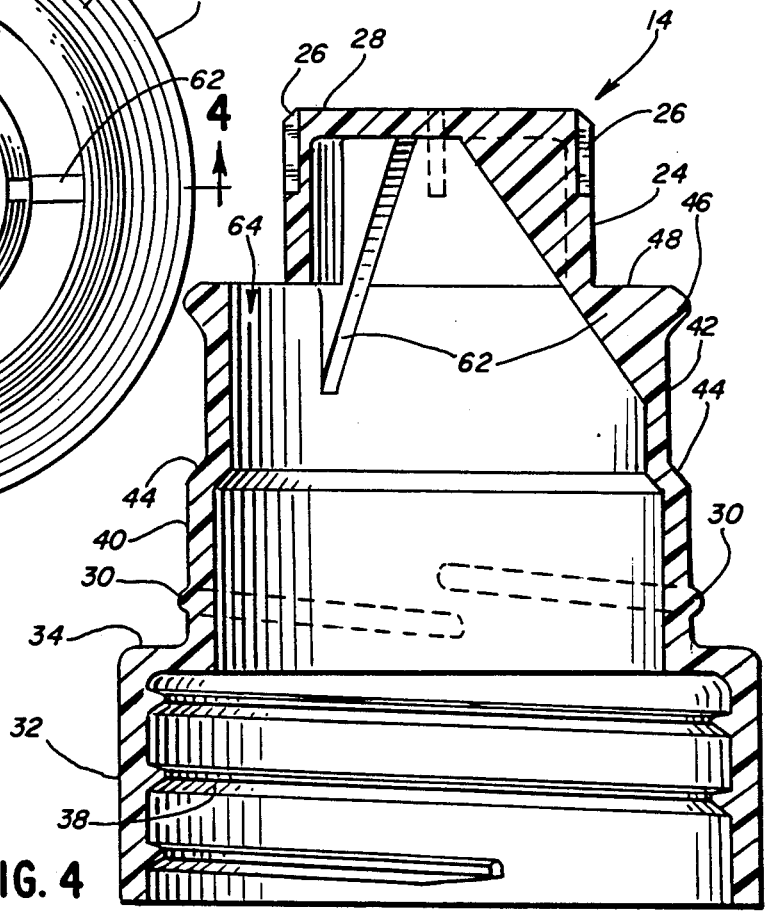
FIG. 4

ADJUSTABLE METERING CLOSURE CAP

This is a continuation of application Ser. No. 07/169,603 filed Mar. 17, 1988, now abandoned.

BACKGROUND OF THE INVENTION

The invention relates generally to a dispensing closure cap and more particularly to an adjustable metering closure cap which has more than one dispensing position.

Dispensing containers have several types of closures, but generally these closures have either an open or a closed position. In the open or dispensing position, the contents of the container can be dispensed at a rate designed by the open position structure. In the closed position, the contents are sealed in the container and cannot be dispensed therefrom.

The dispensing closure can be of the push-pull type or threaded screw type, but generally only have two positions, either fully open or closed. Some attempts have been made at dispensing closures having more than one dispensing position or which have a variety of metered dispensing openings. Typically, these structures are complex or fragile or both.

It would be desirable to provide a dispensing closure cap which has more than one dispensing position, is formed with a minimum of parts and is sturdy in construction.

SUMMARY OF THE INVENTION

The above and other disadvantages of prior art dispensing closure caps are overcome in accordance with the present invention by providing an outer cap body which is adjustable along the length of a central metering post to provide more than one dispensing position The inner periphery of the cap body cooperates with the outer periphery of the post along a portion of the length thereof by a push-pull or a screw type action or both to provide the closed and dispensing positions. The outer periphery of the metering post is configured with slots, grooves, ramps, steps or combinations thereof to provide the various metered dispensing openings to provide a plurality of dispensing flow rates.

BRIEF DESCRIPTION OF THE DRAWINGS

FIG. 1 is a perspective view of one embodiment of an adjustable metering closure cap of the invention;

FIG. 2 is a side plan view of the cap of FIG. 1 in both the open and closed position;

FIG. 3 is a top plan view of one embodiment of the dispensing post of the invention;

FIG. 4 is a side sectional view of the post of FIG. 3 taken along the line 4—4 therein;

DESCRIPTION OF THE PREFERRED EMBODIMENTS

Figure 5A:
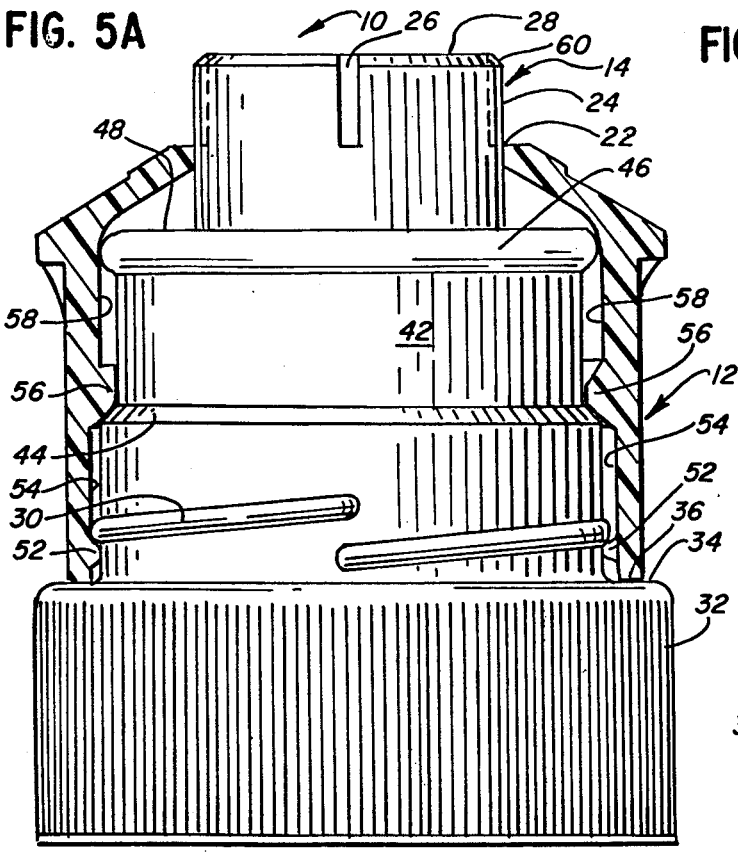
FIGS. 5A and 5B are side and partial side sectional views of the cap of FIG. 1, respectively in the closed and the open positions.

Referring to FIGS. 1 and 2, one embodiment of an adjustable metering closure cap of the invention is designated generally by the reference numeral 10. The closure cap includes an outer cap body 12 and an inner metering post 14. An outer side wall 16 of the cap body 12 is formed for easy manipulation by the user and preferably includes a plurality of outstanding ribs 18 to be grasped by the user.

The cap body 12 is moved along a portion of the length of the post 14 from a closed position illustrated in FIGS. 1 and 2 to a fully opened position 20, indicated by dashed lines in FIG. 2. The cap body 12 includes an inner periphery 22, here circular which mates with an outer periphery 24 of the post 14.

The post 14 includes one or more slots 26 of the same or variable lengths (not illustrated) to provide metered dispensing openings as the cap body 14 is moved to the fully open position 20. In the closed position (FIG. 1), the cap body periphery 22 abuts against the post periphery 24 below the slots 26 to prevent the contents of the container (not illustrated) from being dispensed. As the cap body 12 is moved along the length of the post 14, first the slots 26 are opened to dispense the product therefrom. Then, in the fully open position 20, the cap body periphery 22 clears the top 28 of the post 14 to provide a second dispensing position with an increased dispensing flow rate.

Figure 5B:
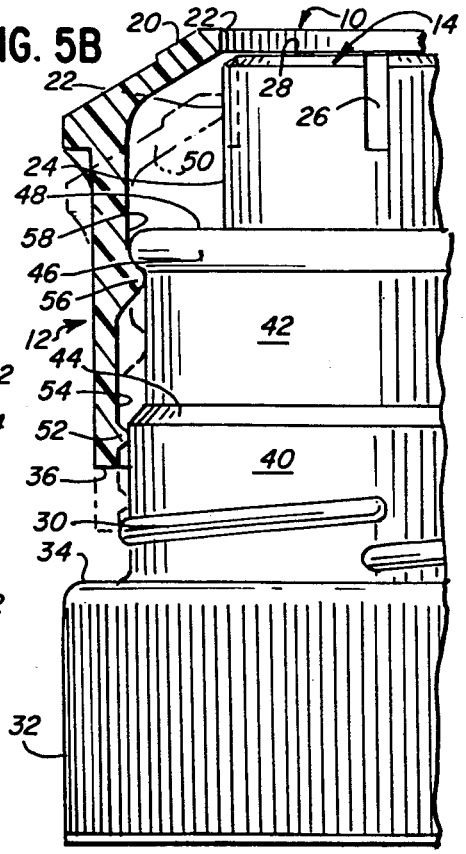

The cap body 12 can be mounted for a push-pull operation or can be mounted on one or more threads 30 for a screw type operation or a combination of both, as illustrated in FIGS. 5A and 5B. The post 14, as best illustrated in FIGS. 3 and 4, includes a base portion 32 having a shoulder 34 against which a bottom edge 36 of the cap body 12 abuts in the fully closed position. The base 32 includes a plurality of threads 38 for securing the post 14 and hence the closure 10 onto a dispensing container, not illustrated The threads 30 are formed on an outer periphery wall portion 40 inset from the base 32 above the shoulder 34.

A second outer periphery wall portion 42 is formed above the wall 40 and joined thereto by a shoulder 44. The periphery wall 42 is inset from the periphery wall 40 and includes an outer flange 46 at an upper end thereof. The flange 46 and hence the wall 42 are joined to the periphery 24 by a shoulder 48.

The cooperative operation of the cap body 12 and the metering post 14 are best illustrated in FIGS. 5A and 5B. The cap body 12 and the post 14 cooperate to provide both a screw type and a push-pull type operation to provide the different dispensing openings. As illustrated in FIG. 5A, the cap body bottom edge 36 abuts the shoulder 34 when the closure 10 is in the closed position. Also, the cap body periphery 22 abuts the post periphery 24 below the openings of the slots 26 to prevent dispensing of the contents of the container.

A first dispensing position 50 is illustrated in dashed lines in FIG. 5B. In this position, the periphery 22 is above the bottom of the openings of the slots 26, enabling the contents of the container, for example, a squeeze type container, to be dispensed therethrough. Although not illustrated, the slots 26 can have varying lengths which could provide multiple dispensing openings for different flow rates. The cap body 12 is moved to the first dispensing opening by unscrewing the cap body 12 on the threads 30, the cap body cooperating therewith by projections or thread tracks 52 formed on an inner wall 54 thereof.

The cap body 12 includes an annular ring 56, which bears against the wall 42 to aid in preventing the contents from leaking down onto the shoulder 34 and to provide a stop for the fully open position 20. In the fully open position 20, the ring 56 bears against the flange 46 to prevent removal of the cap body 12 from the post 14. The primary seal against leakage is provided by an inner wall 58 of the cap body 12, which abuts the flange 46 in all positions.

As clearly illustrated in FIG. 5B, the cap body 12 and the post 14 have a first screw type operation until the tracks 52 pass out of the threads 50. Thereafter, the cap body 12 and the post 14 operate in a push-pull mode with the ring 56 and the flange 46 providing the upper fully open stop for the cap body 12. In the fully open position 20, the periphery 22 clears the periphery 24 and the contents flow through a second larger dispensing opening. The top 28 of the post 14 can include a shoulder 60 to aid in the periphery 22 passing downwardly onto the post 14. The shoulder 48 can be a solid portion with holes therein or can be formed in a plurality of ribs 62, having a plurality of dispensing openings 64 formed between the periphery 24 and the wall 44. The contents flow through the openings 64 to be dispensed from the container.

Figure 6:
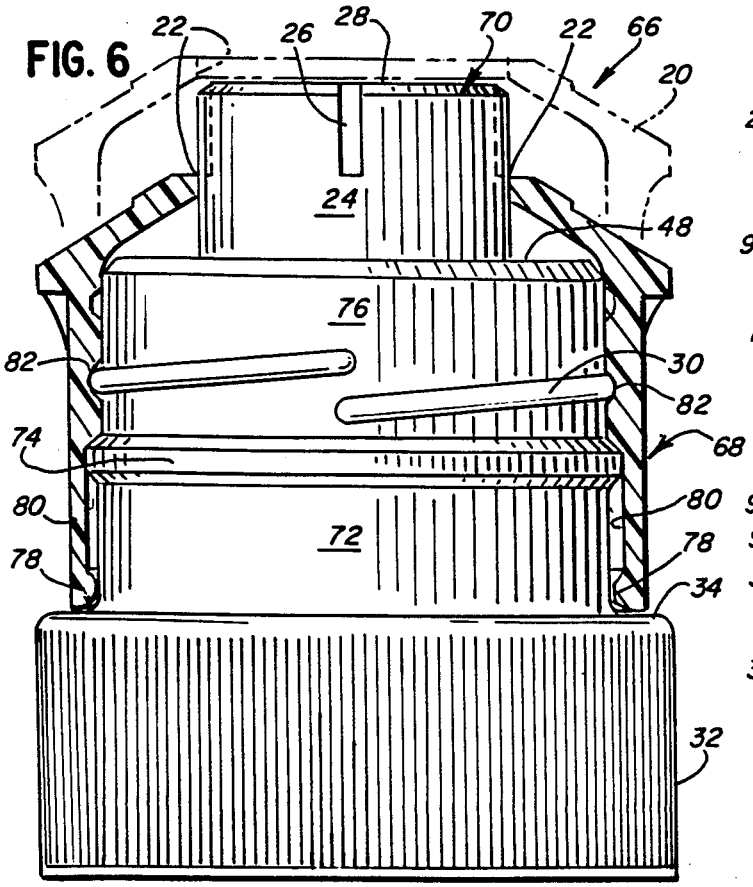
FIG. 6 is a side sectional view of a second embodiment of the metering closure cap of the invention.

A second embodiment of a closure cap of the invention is indicated generally by the reference numeral 66 in FIG. 6, with parts which are substantially unchanged having the same numerals as previously utilized. The closure 66 is shown in solid lines in the closed position and in dashed lines in the fully open position 20. The closure 66 includes a cap body 68 and a metering post 70, which again operate in a push-pull and a screw type mode. The post 70 includes a lower peripheral wall 72 having an annular ring or flange 74 at the upper end thereof. The post 70 further includes a second peripheral wall 76 formed above the flange 74 and which includes one or more of the threads 30 formed thereon.

The cap body 68 includes a lower annular ring 78 on an inner wall 80 thereof. The ring 78 cooperates with the flange 74 to provide the upper, fully open, stop position for the closure 66. The cap body 68 includes a screw track 82 on an inner wall 84, which cooperates with the threads 30 for the first part of the dispensing operation. The track 82 clears the threads 30 to operate in the push-pull mode to provide the second fully open dispensing position.

Figure 7:
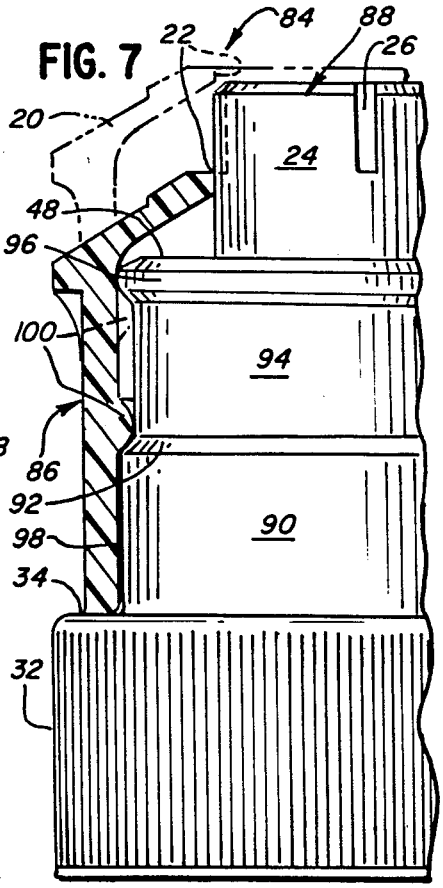
FIG. 7 is a partial side sectional view of a push-pull embodiment of the metering closure cap of the invention.

A solely push-pull operating embodiment of the closure cap of the invention is illustrated in FIG. 7 and is generally designated by the reference numeral 84. The closure 84 includes a cap body 86 and a metering post 88. The post 88 includes a first peripheral wall 90 with a shoulder 92 formed on the top end thereof. A second peripheral wall 94 adjoins the shoulder 92 and has a flange 96 formed at an upper end thereof. The cap body 86 includes a first inner wall 98, which cooperates slidingly with the wall 90. The cap body 86 includes an annular stop ring 100 formed above the wall 98 and which slidingly cooperates with the wall 94. The ring 100 forms a stop against the flange 96 for the open position and against the shoulder 92 in the closed position The closure cap 84 operates only in the push-pull mode, but otherwise operates in a fashion similar to the closures 10 and 66.

Figure 8A:
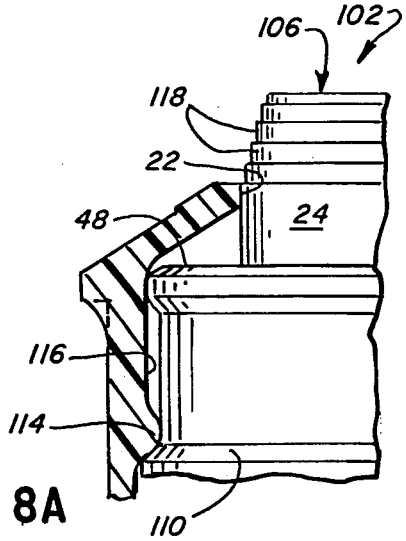
FIGS. 8A and 8B, FIGS. 9A and 9B and FIGS. 10A and 10B respectively are side sectional views of further embodiments of the dispensing post of the invention, respectively in the closed and the open positions.
Figure 8B:
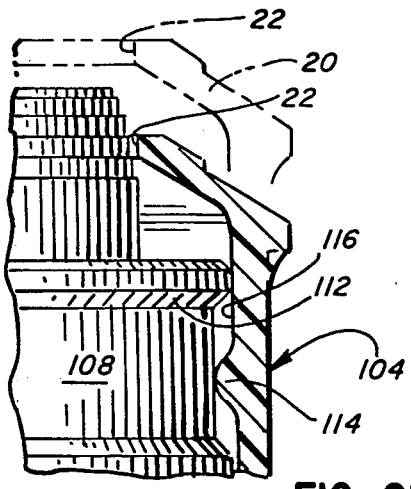

FIGS. 8A and 8B illustrate respectively, the closed position and two open dispensing positions for a closure cap 102. The closure 102 can be designed as a push-pull, as illustrated, or screw type or combination as above described. The closure 102 includes a cap body 104 and a metering post 106. The post 106 includes a peripheral wall 108 having an annular flange 110 and 112 on each end thereof. The flanges 110 and 112 cooperate with a ring 114 formed on an inner wall 116 of the cap body 104 to form the upper and lower stop positions. The wall 116 also cooperates with the flange 112 to prevent leakage of the contents down along the post 106. The shoulder 48 again contains the dispensing openings (not illustrated).

The top of the post 106 includes the outer periphery 24 which cooperates as before with the periphery 22 to close the closure 102. However, the post 106 does not include the slots 26, but instead includes a plurality of stepped peripheral walls 118. As the periphery 22 of the cap body 104 is raised, the dispensing opening increases until the fully open position 20 is reached. In this operation, the number of dispensing positions and hence dispensing flow rates is virtually unlimited.

Figure 9A:
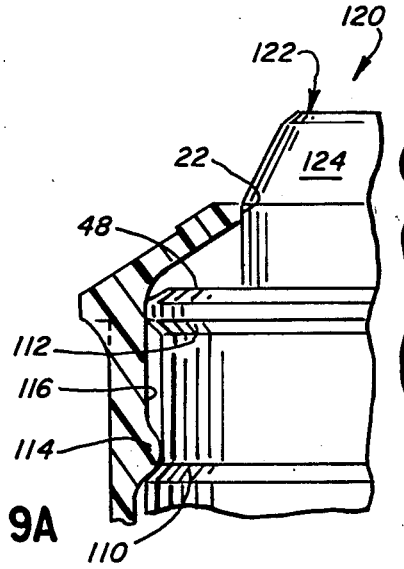
Figure 9B:
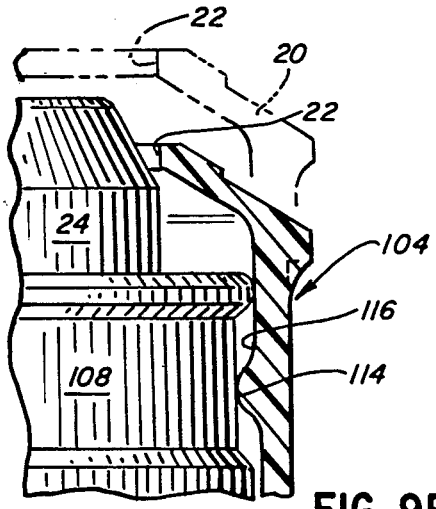

Referring to FIGS. 9A and 9B, another embodiment of closure cap is illustrated generally indicated by the reference numeral 120. The closure 120 includes the same cap body 104, which operates substantially the same as the closure 102. A metering post 122 is the same as the post 106 with the exception of the metering stepped walls 118 of the post 106. The post 122 includes a conical shaped top portion 124 which provides an infinite number of dispensing positions as the periphery 22 is moved relative thereto between the closed and the fully open position 20.

Figure 10A:
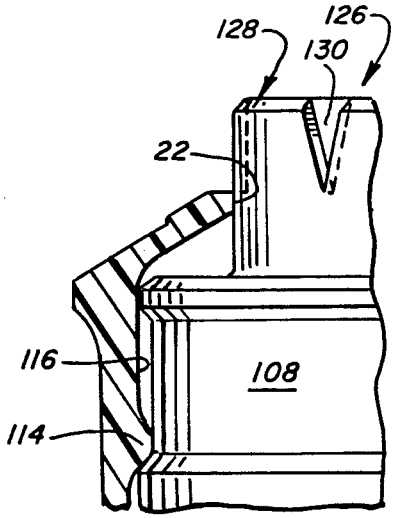
Figure 10B:
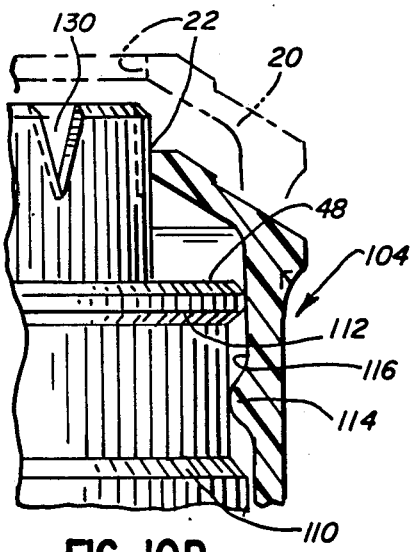

In a like manner, a further embodiment of closure cap is best illustrated in FIGS. 10A and 10B generally indicated by the reference numeral 126. The closure 126 includes a metering post 128 which again is different from the post 106 by the design of the dispensing openings. The post 128 includes a plurality of wedge of V-shaped slots 130. The slots 130 open to the top of the post 128 so that the dispensing openings increase in size as the cap body 104 is moved toward the fully open position 20.

Modifications and variations of the present invention are possible in light of the above teachings. The fully open position 20 can be adjusted so that there is a larger or smaller dispensing opening in the fully open position depending on the type of contents to be dispensed. Further, although not illustrated, the various types of openings could be combined, for example, the slots 26 and the slots 130 with various alignment. Also, the conical post 124 could include the slots 26 or 130 or both. The shape of the slots 26, 130 also can be varied as well as the shape of the cone 124 and the number and shape of the steps 118. The closures preferably are formed by molding from a strong resilient plastic, such as polypropylene. It is therefore to be understood that within the scope of the appended claims, the invention may be practiced otherwise than as specifically described.

What is claimed and desired to be secured by Letters Patent of the United States is:

1. A closure cap for dispensing contents of a container, comprising:

a central upstanding post having a top surface and a substantially cylindrical imperforate peripheral wall, said wall including at least one slot formed along a substantial length of an upper portion thereof opening to said post top surface for metering the contents to be dispensed; and a cap body reciprocally mounted on said central post and having an inner periphery which cooperates with said post peripheral wall and said at least one slot to provide a closure position with said at least one slot being above said cap body inner periphery and at least two dispensing positions for dispensing the contents at least at two different rates as said cap body is moved on said post away from said closure position, one of said dispensing positions provided by said cap body inner periphery clearing said top surface of said post and said second dispensing position provided between said cap body inner periphery and said at least one slot.

2. The closure as defined in claim 1 wherein said cap body is reciprocally mounted on said central post by a push-pull cooperation between a portion of said post having a lower and an upper stop position formed thereon and a projection formed on an inner wall of said cap body which abuts said lower and upper stop positions to form closed and full open dispensing positions.

3. The closure as defined in claim 2 wherein a portion of said reciprocal movement of said cap body is provided by threads cooperating between said post and said inner cap body wall.

4. The closure as defined in claim 1 wherein said cap body is reciprocally mounted on said central post by threads.

5. The closure as defined in claim 1 wherein said at least one slot is a substantially rectangular slot formed in said post peripheral wall and opening to said top surface of said post, said slot being above said cap body inner periphery when said cap body in said closure position.

6. The closure as defined in claim 1 wherein said at least one slot is a substantially V-shaped notch formed in said post peripheral wall and opening at the wider end thereof to said top surface of said post, said slot being above said cap body inner periphery when said cap body is in said closure position.

7. The closure as defined in claim 1 including a plurality of said slots.

8. A closure cap for dispensing contents of a container, comprising:

a central post having a top surface and a substantially cylindrical imperforate peripheral wall, said cylindrical imperforate peripheral wall including a plurality of reduced wall peripheral portions formed in said peripheral wall and opening to said post top surface for metering the contents to be dispensed; and a cap body reciprocally mounted on said central post and having an inner periphery which cooperates with said post peripheral wall to form a variable opening between said cap body inner periphery and said post peripheral wall and to provide a closure position below said reduced wall peripheral portion and a plurality of dispensing positions for dispensing the contents at a plurality of different rates as said cap body is moved on said post away from said closure position, said cap body being reciprocally mounted on said central post by a push-pull cooperation between a portion of said post having a lower and an upper stop position formed thereon and a projection formed on an inner wall of said cap body which abuts said lower and upper stop positions to form closed and full open dispensing positions, a portion of said reciprocal movement of said cap body being provided by threads cooperating between said post and said inner cap body wall.

9. A closure cap for dispensing contents of a container, comprising:

a central post having a top surface and a substantially cylindrical imperforate peripheral wall, said cylindrical imperforate peripheral wall including a plurality of reduced wall peripheral portions formed in said peripheral wall and opening to said post top surface for metering the contents to be dispensed; and a cap body reciprocally mounted on said central post and having an inner periphery which cooperates with said post peripheral wall to form a variable opening between said cap body inner periphery and said post peripheral wall and to provide a closure position below said reduced wall peripheral portion and a plurality of dispensing positions for dispensing the contents at a plurality of different rates as said cap body is moved on said post away from said closure position, said variable opening being provided by said plurality of reduced diameter peripheral wall portions forming a plurality of steps, said steps being above said cap body inner periphery when said cap body is in said closure position.

10. The closure as defined in claim 9 wherein at least one of said dispensing positions is provided by said cap body inner periphery clearing said top surface of said post.

11. The closure as defined in claim 9 wherein said cap body is reciprocally mounted on said central post by a push-pull cooperation between a portion of said post having a lower and an upper stop position formed thereon and a projection formed on an inner wall of said cap body which abuts said lower and upper stop positions to form closed and full open dispensing positions.

12. The closure as defined in claim 9 wherein said cap body is reciprocally mounted on said central post by threads.

13. The closure cap as defined in claim 9 wherein said peripheral wall is of generally conical shaped configuration.

* * * * *